United States Patent [19]

Morelli

[11] 4,009,025

[45] Feb. 22, 1977

[54] LOW PERMEABILITY, NONMAGNETIC ALLOY STEEL

[75] Inventor: Robert T. Morelli, Pittsburgh, Pa.

[73] Assignee: Crucible Inc., Pittsburgh, Pa.

[22] Filed: Mar. 5, 1976

[21] Appl. No.: 664,323

[52] U.S. Cl. ..... 75/123 B; 75/123 G; 75/123 N; 75/123 K; 148/38

[51] Int. Cl.[2] ..... C22C 38/04

[58] Field of Search ..... 75/123 G, 123 N, 123 B, 75/123 K, 128 A, 128 P, 128 N; 148/38

[56] References Cited

UNITED STATES PATENTS 3,010,823 11/1961 Avery et al. ..... 75/123 N

*Primary Examiner*—Arthur J. Steiner

[57] ABSTRACT

A stable, nonmagnetic austenitic alloy steel having extremely low magnetic permeability especially in the unannealed condition, and consisting essentially of, in percent by weight, carbon 0.35 to 0.45, manganese 14 to 16.5, phosphorus 0.05 max., sulfur 0.07 to 0.12, silicon 0.55 to 1.15, nickel 3.5 to 5.5, nitrogen 0.12 max., chromium, 0.50 max. and the balance iron and incidental impurities.

2 Claims, 3 Drawing Figures

LOW PERMEABILITY, NONMAGNETIC ALLOY STEEL

In the electrical industry there are applications for nonmagnetic metals and alloys, such as copper, copper alloys, aluminum and stainless steels; however, these materials are either too costly or of insufficient strength for the intended applications. For example, with stainless steel, substantial amounts of nickel on the order of 8% must be used to insure a stable austenitic structure. Specifically, one important application for stainless steel of this type is in large electrical power transformers where both moderate strength and low magnetic permeability with relatively high electrical resistivity in combination with good formability for fabricability are required. Permeability ($\mu$) is the term used to express the relationship between magnetic induction (B) and magnetizing force (H). This relationship can be "absolute permeability," which is the quotient of a change in magnetic induction divided by the corresponding change in magnetizing force; "specific or relative permeability" is the ratio of the absolute permeability to the permeability of free space, which is expressed as a value of "1.000." A low permeability value is significant in these transformer applications as an indication of the steel's non-magnetic quality because it is desirable to minimize dissipation of the magnetic field of the transformer into the surrounding steel structural support material to maintain structural integrity and correspondingly minimize energy loss. Therefore, since low magnetic permeability is a prime requirement, a stable austenitic structure is critical. Consequently, steels typically used for the purpose contain significant amounts of costly nickel for austenite stability. This adds considerably to the cost of the alloy. Copper is also effective as an austenite stabilizer; however, it is a relatively scarce and expensive alloy ingredient and is undesirable in normal steelmaking practices because of scrap-handling difficulties.

It is accordingly the primary object of the present invention to provide a low-cost, stable austenitic steel characterized by extremely low magnetic permeability, electrical resistivity and strength without requiring the expensive elements nickel and/or copper.

This, as well as other objects of the invention, will be apparent from the following description, specific examples and drawings, in which.

Figure 1:
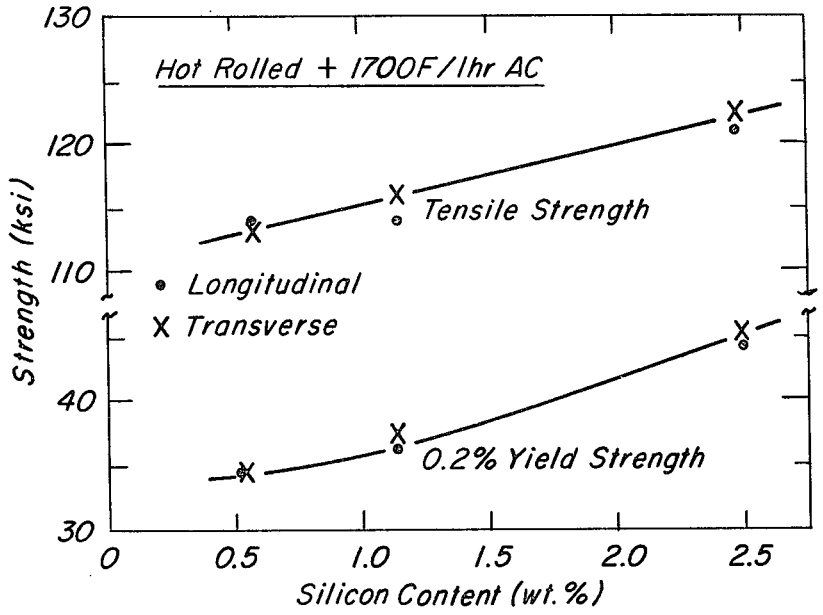
FIG. 1 is a graph showing the yield strength of the reported steels as a function of the silicon content.

Broadly with the steel of the invention the required stable austenitic structure is insured by the presence of high manganese in combination with a relatively low nickel content and control of carbon with chromium at a relatively low level. Silicon is present in a significant amount for the purpose of increasing strength and electrical resistivity, and retaining manganese during melting to insure the retention of sufficient manganese so that the final manganese content of the alloy in combination with the other austenitic-promoting elements, namely nickel and carbon, is sufficient to insure the required stable austenitic structure. Consequently, the presence of manganese within the limits of the invention is critical for achieving the desired properties in a low-cost alloy. Silicon is also critical to insure the presence of manganese in an amount effective for this purpose. On the other hand, if silicon is too high the magnetic permeability of the alloy is significantly adversely affected. The alloy also required sulfur to render it usable from the machinability standpoint. Although in many alloys of this type sulfur cannot be used because of its adverse effect on transverse ductility and welding, this is not the case with the alloy of the present invention. Likewise, from the standpoint of workability and fabricability, as well as weldability, nitrogen must be maintained at a relatively low level.

The alloy can be used in both the hot rolled and hot rolled and annealed condition. For the specific use in electrical transformers as coil-support structural-beam members, the alloy is used in the as-hot-rolled condition. The magnetic permeability of this alloy is not significantly affected by cold reductions of as much as 50%, and thus even with this amount of working, annealing is not necessarily required. Annealing would, however, be beneficial in applications requiring a high degree of formability, particularly bendability.

The following are the limits with respect to the composition of the alloy in accordance with the invention, in percent by weight:

| Chemical | Range | |
|---|---|---|
| Element | Broad | Preferred |
| Carbon | .35 to .45 | .38 to .43 |
| Manganese | 14 to 16.5 | 14.5 to 16.0 |
| Phosphorus | .05 max. | .05 max. |
| Sulfur | .07 to .12 | .07 to .12 |
| Silicon | .55 to 1.15 | .60 to .80 |
| Nickel | 3.5 to 5.5 | 4.5 to 5.5 |
| Nitrogen | .12 max. | .12 max. |
| Chromium | .50 max. | .50 max. |
| Iron | Balance | Balance |

By way of specific examples to demonstrate the aforementioned properties of the steel of the invention the test compositions as identified in Table I were investigated. Heats 1K81 and 1K82 of Table I are steels within the scope of the invention. Heat 1K83 is within the scope of the invention, except with respect to silicon which is above the upper silicon limit for the steel of the invention. The remaining steels of Table I are conventional steels outside the scope of the invention.

TABLE I

ANALYSIS OF LABORATORY HEATS

| Heat | Composition, Weight % | | | | | | | | |
|---|---|---|---|---|---|---|---|---|---|
| No. | C | Mn | S | Si | Ni | P | N | Cr | Fe |
| 1K81 | 0.37 | 16.0 | 0.074 | 0.55 | 5.23 | 0.011 | 0.009 | — | Bal. |
| 1K82 | 0.38 | 16.0 | 0.069 | 1.14 | 5.21 | 0.010 | 0.009 | — | Bal. |
| 1K83 | 0.37 | 15.5 | 0.057 | 2.49 | 5.24 | 0.009 | 0.011 | — | Bal. |
| CMnNi AISI | 0.32 | 11.5 | — | — | 7.75 | — | — | — | Bal. |

TABLE I-continued

| ANALYSIS OF LABORATORY HEATS | | | | | | | | | |
|---|---|---|---|---|---|---|---|---|---|
| Heat | Composition, Weight % | | | | | | | | |
| No. | C | Mn | S | Si | Ni | P | N | Cr | Fe |
| 301 | 0.11 | 1.26 | — | — | — | — | — | 17.15 | Bal. |
| AISI 302 | 0.09 | 0.49 | — | — | — | — | — | 18.30 | Bal. |
| AISI 304 | 0.06 | 0.58 | — | — | 10.18 | — | — | 18.48 | Bal. |

With respect to Heats 1K81, 1K82 and 1K83 of Table I, these were produced by melting a 100-pound heat that was divided into three portions and each provided with the varying silicon contents as shown in Table I. These heats were rolled to ⅝ inch thick plates at a temperature of 2100° F and air cooled from rolling temperature. The steels were readily rolled but Heat 1K83 exhibited some splitting during rolling along the plate length. This is a result of the relatively high silicon content of Heat 1K83. The surfaces of the plates were all similar in both appearance and scaling behavior.

Test specimens were machined from these hot-rolled plates. Tensile specimens were also prepared from the plates after annealing at 1700° F for 1 hour, followed by air cooling. The tensile specimens were 0.252 inch in diameter × 1 inch length in the gauge section. One specimen each was tested in the longitudinal and transverse direction.

The bend test specimen measured ½ × ¼ inch in cross section. The drill machinability tests were based on the time to drill five 0.250 inch diameter holes 0.250 inch deep in each steel using heavy-duty, cobalt-high-speed bits at 405 rpm with a thrust of 2 to 5 pounds. The microstructure of the samples 1K81, 1K82 and 1K83 from the hot rolled plates was austenitic in all instances.

The physical and mechanical properties of the steels are given in Tables II through V.

TABLE II

| HARDNESS AND TENSILE PROPERTIES | | | | | | | | | | |
|---|---|---|---|---|---|---|---|---|---|---|
| Heat No. | Si Content | Hardness (BHN) | Tensile Strength ksi L | Tensile Strength ksi T | 0.2% Yield Strength ksi L | 0.2% Yield Strength ksi T | Elong. in 1 in. % L | Elong. in 1 in. % T | R.A. % L | R.A. % T |
| Hot Rolled Condition | | | | | | | | | | |
| 1K81 | 0.55 | 198 | 129.5 | 125.5 | 63.6 | 56.8 | 58.0 | 54.0 | 63.8 | 46.2 |
| 1K82 | 1.14 | 205 | 127.7 | 124.0 | 57.5 | 49.2 | 60.0 | 58.0 | 64.3 | 51.4 |
| 1K83 | 2.49 | 229 | 129.3 | 128.3 | 54.1 | 54.9 | 65.0 | 57.0 | 65.1 | 51.3 |
| Hot Rolled + Annealed 1700° F/1 hr., AC | | | | | | | | | | |
| 1K81 | 0.55 | 154 | 113.7 | 113.6 | 34.4 | 34.3 | 79.0 | 76.0 | 69.1 | 58.7 |
| 1K82 | 1.14 | 156 | 114.1 | 116.7 | 36.4 | 37.3 | 74.0 | 72.0 | 69.5 | 58.1 |
| 1K83 | 2.49 | 187 | 121.5 | 122.5 | 44.7 | 45.1 | 74.0 | 70.0 | 67.9 | 57.7 |

TABLE III

| DRILL MACHINABILITY OF TRM-45 MOD | | | |
|---|---|---|---|
| | | Average Drill Time, Seconds | |
| Heat No. | Si (%) | Heavy Duty Drill | Cobalt HSS Drill |
| Standard | 0.22 | 14.5 | 10.3 |
| 1K81 | 0.55 | 15.0 | 9.8 |
| 1K82 | 1.14 | 13.6 | 9.7 |

TABLE III-continued

| DRILL MACHINABILITY OF TRM-45 MOD | | | |
|---|---|---|---|
| | | Average Drill Time, Seconds | |
| Heat No. | Si (%) | Heavy Duty Drill | Cobalt HSS Drill |
| 1K83 | 2.49 | 15.9 | 10.5 |

TABLE IV

| MAGNETIC MEASUREMENTS OF TRM-45 MOD | | | | | | |
|---|---|---|---|---|---|---|
| | | Magne Gage Reading | | | Permeability at H=100 Oe | |
| Heat No. | Si (%) | Hot Rolled | 50% Cold reduction | Fractured Tensile Specimen | Hot Rolled | 50% Cold Rolled |
| 1K81 | 0.55 | 0 | 0 | 0 | 1.002 | 1.004 |
| 1K82 | 1.14 | 0 | 0 | 0 | 1.002 | 1.009 |
| 1K83 | 2.49 | 0 | 0 | 2 | 1.020 | 1.070 |

TABLE V

| ELECTRICAL RESISTIVITY OF TRM-45 MOD | | |
|---|---|---|
| Heat No. | Si (%) | Electrical Resistivity (micro-ohm-cm) |
| 1K81 | 0.55 | 72.4 |
| 1K82 | 1.14 | 76.1 |
| 1K83 | 2.49 | 84.4 |

The hardness and strength of the steels of the invention as compared to the conventional steels were determined and the data are reported in Table II. The role of silicon from the standpoint of strengthening was established after annealing of the samples at 1700° F. This data is reported on the graph constituting FIG. 1 of the drawings. FIG. 1 illustrates that the tensile and yield strengths increase slightly annd nearly linearly with silicon content. On the other hand ductility tends to decrease slightly with increased silicon.

A portion of a plate from the steels 1K82 and 1K83 was welded to a mild steel strip in a lap joint and the plates were also butt-welded to themselves without difficulty. The butt-joints of the steels were subject to 90° bends without cracking.

Figure 2:
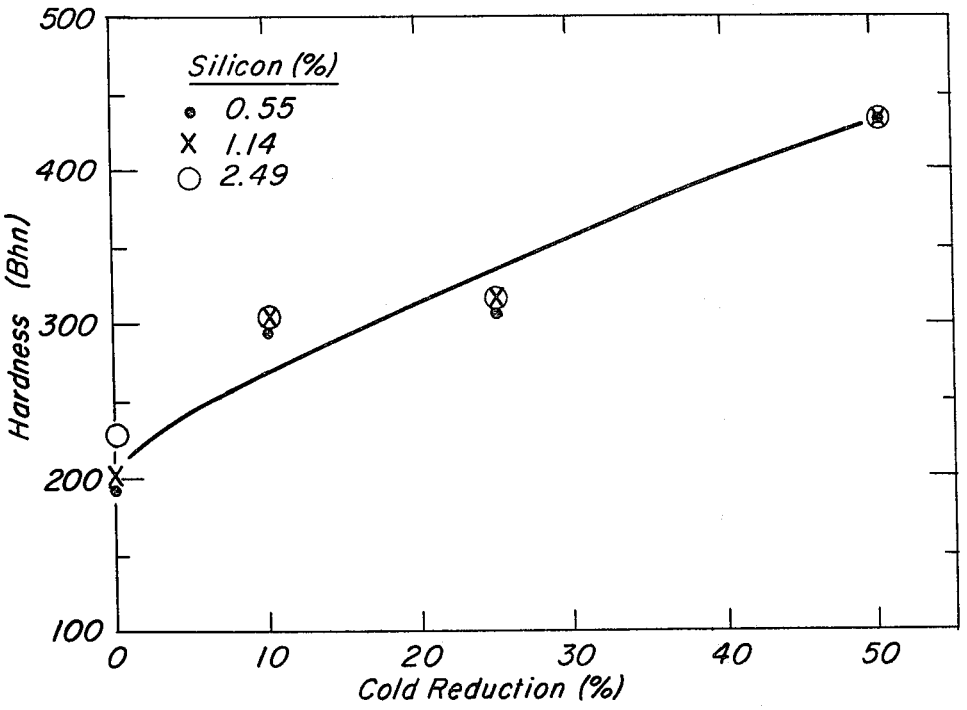
FIG. 2 is a graph showing the effect of cold working on the hardness of the reported steels.

The drill machinability data indicated the same behavior for Steels 1K81 and 1K82; whereas, there was a tendency for the higher silicon sample 1K83 to be more difficult to drill. This data is reported on Table III. Coupons from each hot rolled plate were cold rolled up to 50% reduction to determine the work hardening propensity of the steels. The results presented in FIG. 2 show that the steels increased in hardness essentially linearly with cold reduction and at the same rate. The increase in hardness was independent of the silicon content. The results of magnetic testing are shown in Table IV. The magne gage readings for all except the fractured tip of the tensile specimens from sample 1K83 having 2.49% silicon were nil. Permeability was 1.002 for both Steels 1K81 and 1K82, both of which are within the scope of the invention. A 50% cold reduction increased the permeability of samples of Steels 1K81 and 1K82 to 1.004 and 1.009, respectively. Sample 1K83, which contains silicon outside the scope of the invention, had a permeability of 1.020 in the hot-rolled condition. This indicates that it is critical to maintain silicon at or below the maximum in accordance with the invention.

Figure 3:
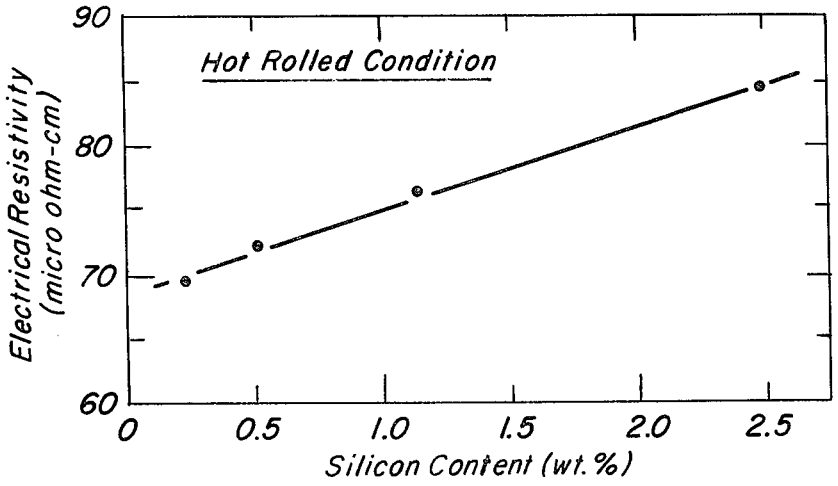
FIG. 3 is a graph showing the electrical resistivity of the reported steels.

The electrical resistivity of the steels as reported in Table V and plotted in FIG. 3 show a linear increase in resistivity with silicon increases. These data show the beneficial effect of silicon from the standpoint of reducing eddy current losses in the presence of strong electrical fields. On the other hand restriction of the silicon content used for this purpose in accordance with the invention is dictated by the adverse effect of silicon from the standpoint of magnetic permeability and machinability. This consideration of the desired combination of properties for this steel establishes the criticality of the silicon limits in accordance with the invention.

I claim:

1. A stable austenitic steel characterized by low magnetic permeability in both the annealed and unannealed condition, said steel consisting essentially of, in weight percent, carbon 0.35 to 0.45, manganese 14 to 16.5, phosphorus 0.05 max., sulfur 0.07 to 0.12, silicon 0.55 to 1.15, nickel 3.5 to 5.5, nitrogen 0.12 max., chromium 0.50 max. and the balance iron and incidental impurities.

2. A stable austenitic steel characterized by low magnetic permeability in both the annealed and unannealed condition, said steel consisting essentially of, in weight percent, carbon 0.38 to 0.43, manganese 14.5 to 16.00, phosphorus 0.05 max., sulfur 0.07 to 0.12, silicon 0.60 to 0.80, nickel 4.5 to 5.5, nitrogen 0.12 max., chromium 0.50 max. and the balance iron and incidental impurities.

* * * * *